United States Patent [19]

Simonsen

[11] Patent Number: 4,635,617

[45] Date of Patent: Jan. 13, 1987

[54] GREASE CATCH BASIN WITH SOLVENT RESERVOIR FOR USE WITH COOKING EXHAUST SYSTEMS

[76] Inventor: Kenard A. Simonsen, R.R. 1, P.O. Box 116A, Lennox, S. Dak. 57039

[21] Appl. No.: 729,213

[22] Filed: May 1, 1985

[51] Int. Cl.[4] ..... F24C 15/20

[52] U.S. Cl. ..... 126/299 E; 55/242; 55/385 R; 55/DIG. 36

[58] Field of Search ..... 55/242, 385 R, 406, 55/DIG. 36; 126/299 R, 299 D, 299 E; 239/14 S; 98/115.1

[56] References Cited

U.S. PATENT DOCUMENTS

| | | | |
|---|---|---|---|
| 3,248,858 | 5/1966 | Toke | 55/DIG. 36 X |
| 3,393,497 | 7/1968 | Donnelly | 126/299 D X |
| 3,406,500 | 10/1968 | Deming | 55/406 X |
| 3,795,181 | 5/1974 | Lawson | 55/DIG. 36 X |
| 4,323,373 | 4/1982 | Fritz | 55/DIG. 36 X |
| 4,460,386 | 7/1984 | Diachuk | 126/299 E |

*Primary Examiner*—Harold Joyce

*Attorney, Agent, or Firm*—William R. Hinds

[57] ABSTRACT

For use particularly with exhaust systems from cooking areas, such as roof-mounted restaurant exhaust fans, a grease catch basin is mountable about the exhaust duct so as to collect condensed or precipitated grease from exhaust system parts lying above the catch basin, typically an exhaust fan and housing. Such condensed or precipitated grease flows or drips into the catch basin surrounding the duct. The catch basin is of sheet aluminum, and typically is mounted about the conventional roof curb through which the exhaust duct extends. A solvent reservoir is mounted in the upper part of the grease catch basin, and contains a solvent for breaking down grease. Solvent passes from the reservoir into the catch basin preferably via a rope wick extending through the bottom of the solvent reservoir into the catch basin. Wicking action can be controlled by controlling the compression of the rope wick. The catch basin is open-topped, such that rain water also can fall into the catch basin. Openings are provided in the lower walls of the catch basin, above the bottom thereof, such that the contents of the catch basin can flow through these openings onto a roof or other structure when the contents exceed a certain level. The contents typically will be broken down grease, solvent and water. By breaking down the grease through the solvent action before it passes onto the roof, the corrosive action of cooking grease on roofing materials is eliminated or minimized, and potential fire hazards are reduced, in addition to avoidance of accumulation of unsightly and smelly fats and greases on a roof or other structure. The system is passive and simple, requiring minimal maintenance at fairly extended intervals.

16 Claims, 3 Drawing Figures

GREASE CATCH BASIN WITH SOLVENT RESERVOIR FOR USE WITH COOKING EXHAUST SYSTEMS

FIELD OF THE INVENTION

This invention relates to apparatus for use in connection with exhaust systems for exhausting air and vapors from areas where volatilized grease and vapors are generated, such as kitchens, restaurants, fast food establishments, etc. The invention particularly relates to apparatus and devices for collecting and disposing of condensed or precipitated grease in such exhaust systems, through the provision of a simple and inexpensive catch basin provided with a solvent reservoir, with solvent passing gradually from the reservoir preferably by a wicking action through wicks extending between the reservoir and the catch basin.

BACKGROUND

Restaurants and other facilities where substantial cooking is done generate substantial amounts of cooking vapors and air containing volatilized or vaporized grease, and removal and disposal of this grease has been and continues to be a problem in the restaurant industry. Such restaurants and the like require kitchen exhaust systems for removing heat, cooking vapors, and the like. There have been numerous proposals to remove grease from the exhaust air both inside and outside the restaurant buildings, but complete removal within the building is virtually impossible. Therefore, some grease vapors pass out of the building through the exhaust system, which typically is in the form of an exhaust fan or fans mounted on the roof of the building and connected with an exhaust duct or ducts passing through the roof. Substantial amounts of condensed or precipitated grease collect about the fan structure and fan housing, from where it flows or drips downwardly onto the roof. However, the corrosive action of cooking grease is such that many roofing materials deteriorate quickly when saturated with grease. Additionally, accumulations of fats and greases pose potential fire hazards on the roof, and also are unsightly and smelly. However, there are many instances where this condensed or precipitated grease is permitted simply to flow or drip onto the roof surface, despite the adverse consequences. It is known to arrange sand boxes or the like beneath the exhaust fan housing on a restaurant roof, but this requires frequent and troublesome maintenance. Other forms of grease collectors have been proposed to catch condensed or precipitated grease, some of these involving the addition of water so as to facilitate removal of the grease through a skimming action. This is of questionable effectiveness, and again requires frequent and troublesome maintenance and attention.

Typical earlier proposals of which I am aware include those shown in King U.S. Pat. No. 3,410,195 issued Nov. 12, 1968, Graswich et al. U.S. Pat. No. 3,324,629 issued June 13, 1967, Donnelly U.S. Pat. No. 3,393,497 issued July 23, 1968, and Donnelly U.S. Pat. No. 3,581,467 issued June 1, 1971. The King and Donnelly patents are basically "in house" removal systems involving baffling, water sprays, water and detergent sprays, centrifugal baffles, etc. The Donnelly patents include removal and collection systems both inside the building and outside the building, including water-supplied catch basins on the roof about the exhaust fan structure for collecting grease and retaining it in the basins through a skimmer arrangement. Despite the numerous proposals for solutions, I am personally aware that there are numerous installations where condensed or precipitated grease simply flows or drips from the exhaust fan and housing onto the surrounding roof, with the detrimental effects previously mentioned.

FEATURES AND ASPECTS OF THE INVENTION

In accordance with my invention, I provide a simple, reliable and low-maintenance solution to the problem of grease accumulation, particularly on restaurant roofs and the like in the area of the rooftop exhaust fan. My invention provides a grease catch basin, preferably of heavy gauge sheet aluminum, which preferably is mounted to and about the conventional roof curbs which surround the exhaust duct, and on which exhaust fans are mounted. Mounting of the catch basin is a relatively simple procedure, and in fact the complete installation can be made normally in less than one hour. Basically, the exhaust fan is removed, the catch basin is mounted about the roof curb and leveled and secured to the roof curb, the solvent reservoir is set in place in the catch basin if not already installed in the catch basin, the solvent solution is placed in the solvent reservoir, with some solution being placed also in the catch basin, the wick effect flow through the rope wick is checked and adjusted if necessary, and the exhaust fan is reinstalled. In those few instances where the roof curb height is not high enough (typically a minimum of six inches at the lowest point), it is necessary to raise the roof curb and the ventilation duct to the necessary height to provide vertical clearance for the catch basin. The supply of grease solvent typically will last about one month, and its replenishment and any necessary attendant adjusting or maintenance requires only about ten minutes per month.

I have found the rope wick to be the preferred structure for passing solvent from the solvent reservoir to the grease catch basin. Rope wicks are reliable and long lasting, easily installed, and inexpensive. However, in its broader aspects, the invention contemplates and encompasses other controlled flow arrangements between the solvent reservoir and the grease catch basin.

It is advantageous to have the grease catch basin open to receive rainfall, such that the catch basin typically will contain water, solvent and grease which has been broken down by the solvent. When the level reaches openings in the basin side walls located above the bottom of the basin, the liquids flow out on the roof to be evaporated, and the material flowing onto the roof basically is as harmless to the roof as water.

Other features, aspects, advantages and objects of the invention will become apparent to those skilled in the art from the ensuing description of preferred embodiments, taken in conjunction with the appended drawings.

DETAILED DESCRIPTION OF THE DRAWINGS

DETAILED DESCRIPTION OF PREFERRED EMBODIMENTS

Figure 1:
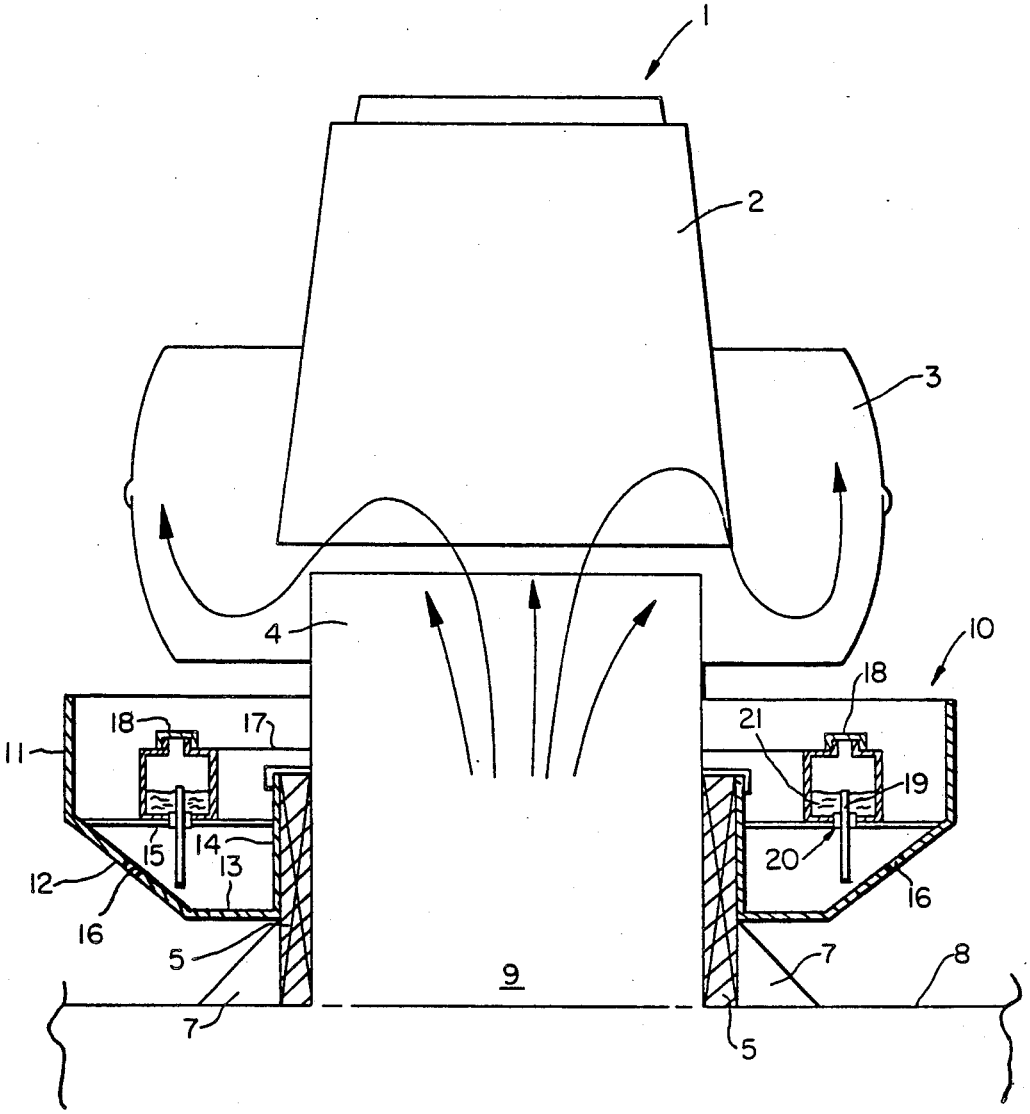
FIG. 1 is a diagrammatic elevation view of a conventional restaurant rooftop exhaust fan, ducting, roof curbing, etc., showing my invention mounted about the curbing and beneath the fan and fan housing.

Referring to FIG. 1, a restaurant rooftop, typically a built-up roof is indicated at 8. An exhaust duct indicated generally at 9 passes through an opening in the roof which is conventionally defined and surrounded by a roof curb, typically formed of lumber 5 which is covered with protective sheet metal flashing indicated at 7, the metal flashing completely covering the exterior surfaces of the lumber members 5, and sometimes also extending over the inner surfaces. A conventional restaurant exhaust fan is generally indicated at 1, comprises a motor driven exhaust fan diagrammatically illustrated at 2 and a fan housing diagrammatically illustrated at 3, the overall exhaust fan structure typically being mounted to the roof curb by a duct member 4, which may have horizontal flanges bearing against and fitting over and about the upper surface of the roof curb. This is all entirely conventional structure, and as such forms no part of the present invention.

Figure 2:
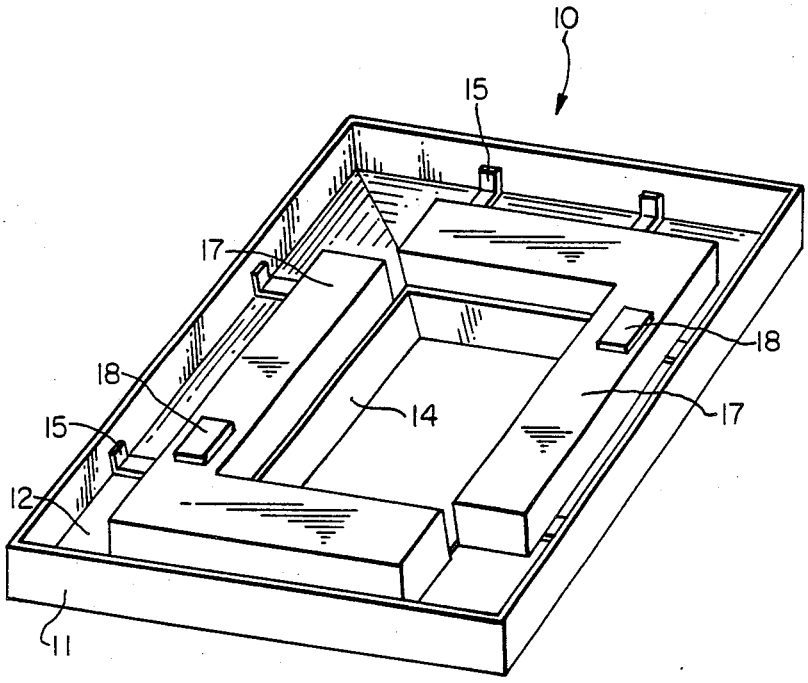
FIG. 2 is a perspective view from above of a complete assembly of the grease catch basin and solvent reservoir(s) in accordance with a preferred embodiment.

A grease catch basin generally indicated at 10 is mounted to and about the roof curb such that the catch basin extends completely about the roof curb and lies below the exhaust fan and fan housing. The catch basin comprises outer walls 11, inner walls 14, bottom 13, and inclined lower walls 12, formed with openings 16 above the bottom 13 so as to maintain, for instance, at least an inch or two of liquid in the bottom of the catch basin. The catch basin is secured to the roof curb by screws or nails passing through inner walls 14 into the lumber of the roof curb. Metal reinforcing straps 15 extend between and are connected to inner and outer walls 11 and 14 to strengthen the sheet metal catch basin, and also to provide support for solvent reservoir(s) 17. As shown in FIG. 2, it is convenient to fabricate two L-shaped solvent reservoirs 17, and locate them on the metal strips or bands 15 such that they encompass almost the full length of the catch basin. The reservoirs 17 are provided with filler openings which are closed by filler caps 18. The solvent reservoirs are formed with openings in their bottom surfaces, through which openings rope wicks 19 extend and are secured by compression fittings generally indicated at 20. While not so illustrated in FIG. 1, I prefer that the rope wicks 19 extend downwardly into the catch basin to a level below the openings 16 so that the bottoms of the rope wicks will be submerged in the basin contents, although I do not consider this to be a critical feature. Two rope wicks are typically provided for each L-shaped reservoir, one in each leg of the L. The grease solvent is indicated at 21 in the reservoir(s). As shown, the catch basin is open-topped, so as to collect not only grease but also rain water which facilitates flushing of the catch basin.

Figure 3:
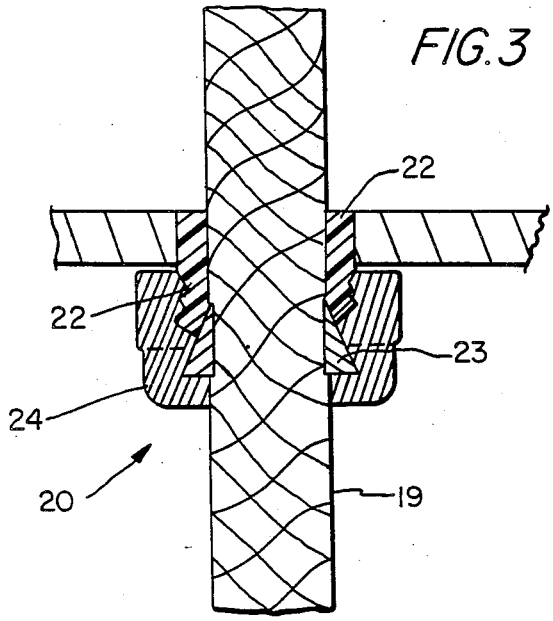
FIG. 3 is a detail elevation showing one of the rope wicks passing through a typical compression fitting connected to the bottom of the solvent reservoir.

A typical mounting of a rope wick in the bottom wall of a reservoir is illustrated in FIG. 3. As illustrated, an externally threaded nipple 22 is mounted in an opening in the reservoir bottom wall, and secured in any convenient manner. The rope wick 19 passes fairly snuggly through the opening in the nipple 22. Nipple 22 is formed at its lower end with a tapered or conical surface, with which a seal ring 23 cooperates, the seal ring being of trapezoidal or triangular section, and being disposed between the tapered surface of nipple 22 and a transverse annular surface of internally threaded cap or nut 24, such that as cap 24 is threaded onto nipple 22, seal ring 23 is forced radially inwardly into tight gripping and sealing engagement with a short length of the exterior surface of the rope wick. The seal ring 23 can be of rubber or flexible plastic material, and the extent of compression and sealing of the wick is readily controlled by manipulation of nut or cap 24, which functions as a compression nut. The illustrated mounting is merely exemplary of many suitable compression fittings which could be used. While a compression fitting is preferred because of the ease of control and variation of compression, it will be feasible in many instances to mount the rope wick by a simple rubber grommet, as is well-known. In fact, both grommets and compression fittings are known for mounting rope wicks in other environments, as shown in Hardy et al. U.S. Pat. No. 4,187,638 issued Feb. 12, 1980, involving a rope wick applicator for herbicides and the like. The rope wick and the fittings used in the instant invention may be as described and illustrated in said U.S. Pat. No. 4,187,638, the disclosure of which is hereby incorporated herein by reference.

The number of rope wicks and the controlled flow characteristic of each rope wick can be varied to particular circumstances, so as to provide more solvent flow in instances of heavy use where greater amounts of grease are collected in the grease catch basin.

Fabrication and installation of catch basin/solvent reservoirs in accordance with the invention are in keeping with standard sheet metal practice. The catch basin will be sized and fabricated appropriately for a particular exhaust system, such that the catch basin fits closely around the roof curb. The catch basin and solvent reservoirs are fabricated separately, and preferably combined at the time of installation at the job site. In fact, it is not necessary for the solvent reservoirs to be secured to the catch basin, but they can be wired or strapped down onto the metal reinforcing strips if desired. As to installation at the job site, the exhaust fan is first removed from the roof curb. The roof curb height should be checked to ensure a minimum of six inches at the lowest point. If the roof curb is not high enough, it can be easily built up to the required height, extending the internal ventilation duct at the same time, and extending the electrical wiring for the exhaust fan if necessary. The catch basin is then slipped down over the roof curb until the top edge of the inner walls of the catch basin is substantially flush with the top of the roof curb. The catch basin is then accurately leveled, and securely fastened in place with nails or screws. The solvent reservoir or reservoirs are then set in place, and filled with the solvent solution. Preferably at least one inch of the solvent solution is placed in the grease catch basin so as to ensure immediate start of the grease breakdown process. The exhaust fan is then reinstalled, and installation is complete. A typical installation is initially filled with approximately five gallons of grease solvent, which typically lasts for four to six weeks before refilling is required. Periodic checks are made to ensure that the solvent flow is sufficient without being excessive, and flow is adjusted as necessary. In extreme cases of miscalculation, the rope wicks may be increased or decreased in number to ensure a proper rate of flow.

Various grease solvents are available for use in the invention, one example being a heavyweight degreaser specially made for degreasing, and manufactured and sold by Grace Lee Products, 1414 Marshal Street, Minneapolis, Minn., but numerous degreasers, detergents or the like may be used advantageously in the instant invention.

As will be readily apparent, grease will drip or flow from the fan housing and related structure into the catch basin, where the grease will be broken down by the solvent. Thus, the catch basin will contain solvent, broken down grease, and intermittent rainwater, all of which will flow out onto the roof to be evaporated as it reaches the level of the openings in the grease catcher basin.

Having described and illustrated preferred embodiments of my invention, including the fabrication and use thereof, in such detail as to permit persons skilled in the art to make and use the invention without undue experimentation, it should be understood that the described and illustrated embodiments are exemplary of the invention, and are not intended to be limiting in any respect, the scope of the invention being as defined in the subjoined claims, taken in the light of the foregoing specification and illustrations.

I claim:

1. In combination with exhaust means for exhausting air and vapors from an area where volatilized grease and vapors may be generated, the improvement comprising means forming a grease catch basin for collecting condensed or precipitated grease which condenses or precipitates on and flows or drips from some part of said exhaust means, means forming a grease solvent reservoir containing solvent for breaking down grease, means locating said reservoir relative to said grease catch basin such that gravity flow of solvent from the reservoir to the catch basin can occur, means forming a controlled flow path for gradual flow of solvent from said reservoir into said catch basin, and means for permitting outflow of the contents of said catch basin when said contents reach a predetermined level in the catch basin.

2. Apparatus as claimed in claim 1 wherein said catch basin is open-topped and located such that rain water can collect therein.

3. Apparatus as claimed in claim 2 wherein said catch basin and solvent reservoir are located on the roof of a building, said exhaust means passes through and extends above the roof, and said catch basin lies below parts of the exhaust means extending above the roof.

4. Apparatus as claimed in claim 3 wherein said roof includes a built-up curb surrounding an exhaust duct and surmounted by an exhaust fan, and said catch basin surrounds and is mounted to said built-up curb.

5. Apparatus as claimed in claim 4 wherein said means for permitting outflow of the contents of said catch basin comprises openings through walls of the catch basin opening into the catch basin above the bottom thereof for permitting outflow onto the surrounding roof.

6. Apparatus as claimed in claim 5 wherein said solvent reservoir is located in the catch basin above said openings.

7. Apparatus as claimed in claim 6 wherein said means forming a controlled flow path comprises wick means extending from the interior of said reservoir into said catch basin for passing solvent to the catch basin by wicking action.

8. Apparatus as claimed in claim 7 wherein said wick means extends through the lower surface of said reservoir to a level in said catch basin lower than said outflow openings.

9. Apparatus as claimed in claim 8 further comprising compression means for controllably compressing said wick means to a greater or lesser extent in the area where the wick means passes through the lower surface of the reservoir so as to control the flow of solvent therealong.

10. Apparatus as claimed in claim 9 wherein said compression means comprises a compression fitting connected to the reservoir, with the wick means passing through the fitting.

11. Apparatus for use in collecting, breaking down and disposing of condensed or precipitated grease from an exhaust system, comprising means forming a grease catch basin, means forming a grease solvent reservoir, means for supporting the solvent reservoir such that gravity flow of solvent from the reservoir to the catch basin can occur, means forming a controlled flow path for gradual flow of solvent from the reservoir into the catch basin, and means for permitting outflow of contents of the catch basin when the contents reach a predetermined level.

12. Apparatus as claimed in claim 11 wherein said means forming a controlled flow path comprises wick means extending from the interior of the reservoir into said catch basin.

13. Apparatus as claimed in claim 12 wherein said catch basin has inner and outer walls extending in endless paths to define a catch basin open at its center such that the catch basin can be mounted about an exhaust duct to collect grease which flows or drips from exhaust structure above the catch basin, the catch basin being open-topped, and having outflow openings at a level above its bottom surface.

14. Apparatus as claimed in claim 13 wherein said catch basin includes metal strips connected to and extending between upper parts of the inner and outer walls thereof, and said solvent reservoir is supported by said metal strips such that said wick means extends into the catch basin to a level below said outflow openings.

15. Apparatus as claimed in claim 14 wherein said wick means passes through an opening in the bottom of said reservoir, and is controllably compressed in the area of the opening so as to control solvent flow therealong.

16. Apparatus as claimed in claim 15 wherein said wick means is a rope wick.

* * * * *